US007165365B1

(12) United States Patent
Wang

(10) Patent No.: US 7,165,365 B1
(45) Date of Patent: Jan. 23, 2007

(54) SATELLITE READY BUILDING AND METHOD FOR FORMING THE SAME

(75) Inventor: Arthur W. Wang, Buena Park, CA (US)

(73) Assignee: The DirecTV Group, Inc., El Segundo, CA (US)

( * ) Notice: Subject to any disclaimer, the term of this patent is extended or adjusted under 35 U.S.C. 154(b) by 0 days.

(21) Appl. No.: 09/542,243

(22) Filed: Apr. 3, 2000

(51) Int. Cl.
*E04C 2/52* (2006.01)

(52) U.S. Cl. ..... 52/220.1; 434/878; 342/359; 343/766

(58) Field of Classification Search ..... 52/220.1, 52/220.7; 174/48, 69, 71 R, 72 R, 72 A; 343/702, 700 MS, 766, 878; 379/59; 342/375, 342/359, 81; 439/449
See application file for complete search history.

(56) References Cited

U.S. PATENT DOCUMENTS 4,710,778 A * 12/1987 Radov ..... 343/882
5,561,433 A * 10/1996 Chaney et al. ..... 342/359
5,689,276 A * 11/1997 Uematsu et al. ..... 343/872
5,835,128 A * 11/1998 Macdonald ..... 348/8
5,940,028 A * 8/1999 Iwamura ..... 342/359
6,037,912 A * 3/2000 DeMarre ..... 343/815
6,166,329 A * 12/2000 Oliver ..... 174/58
6,166,700 A * 12/2000 Jenkin et al. ..... 343/761
6,166,705 A * 12/2000 Mast ..... 343/853
6,201,509 B1 * 3/2001 Zhang ..... 343/791
6,204,823 B1 * 3/2001 Spano ... ..... 343/766
6,259,415 B1 7/2001 Kumpfbeck et al. ..... 343/765
6,335,753 B1 * 1/2002 McDonald ..... 348/14
6,362,794 B1 * 3/2002 Yu ..... 343/702

OTHER PUBLICATIONS

Home Wireless Networks, Inc. Home Networking; Sep. 1999; www.webproforum.com/home_net/index.html.
Amitava Dutta-Roy, Contributing Editor; Networks for Homes; IEEE Spectrum Dec. 1999.

* cited by examiner

*Primary Examiner*—Naoko Slack
*Assistant Examiner*—Chi Q. Nguyen
(74) *Attorney, Agent, or Firm*—Georgann S. Grunebach

(57) ABSTRACT

A satellite ready building comprises a plurality of studs and satellite wires positioned adjacent to the studs having a first termination and a second termination. A connector is coupled to the second termination of the wires. The first termination is coupled through the roof or the siding of the building. Drywall is installed in the house after the wires are installed. The first termination may be installed in a radome positioned on the roof of the building.

17 Claims, 3 Drawing Sheets

SATELLITE READY BUILDING AND METHOD FOR FORMING THE SAME

TECHNICAL FIELD

The present invention relates generally to satellite communication services and, more particularly, to forming a satellite ready building.

BACKGROUND ART

Satellite services such as DirecTV® and DireCPC™ are increasingly popular. These services through a satellite provide television programming as well as computer downloads and Internet access respectively.

These services require the installation of a satellite dish antenna on the outside of the building. Wires are run from the outside of the building into the building where connections are made to a television or a personal computer.

Many times it is difficult to place the wires or the antenna so that the apparatus is aesthetically pleasing. That is, wires may not be conveniently run within walls and the satellite dish typically is a parabolic antenna that extends from the roof or the side of the house. Moving the TV or personal computer to another room involves re-routing the wires or adding additional wires to the home. This wiring may also be expensive and thus cost prohibitive for many potential customers. The process of outdoor unit (ODU) installation, customized routing, drilling through walls, or painful connection debugging dramatically constraints the market acceptance of satellite based services, including video DirecTV® or data DirecPC™.

It is therefore one object of the invention to provide a satellite ready building that allows users to easily move the TV or personal computer within the building.

Another growing drawback of using parabolic antenna for satellite based services is its visual intrusion that is disfavored by most community dependent regulations. Most of new houses or multi-unit condominiums are built in a gated community or a privately controlled environment. These buildings typically are regulated more strictly by a privately formed resident association than the buildings without association. However, an association based community is the trend of most new houses due to attractive safety/cost advantages and the convenience of sharing public facilities. The installations of satellite antennas will likely continue to encounter more difficulty in this manner.

SUMMARY OF THE INVENTION

It is therefore one object of the invention to provide a satellite ready building that allows users to move and "plug-in" the user device such as the television or computer into various rooms of the building. A further object of the invention is to provide a building that is pre-wired prior to completion and prior to installation of the drywall so that the wires are hidden within the walls to form an aesthetically pleasing building.

Another object of the invention is to use a low profile antenna and a matching radome. The low profile antennas can be implemented through many previously proposed techniques, which will be discussed in the main body of the invention. The matching radome is a result of selecting appropriate material, using right color, and design engineering. Both approaches (low-profile antenna and matching radome) reduce visual intrusion and enhance the market acceptance considering the trend of adapting new regulations.

In one aspect of the invention, a method of forming a satellite ready building comprises the steps of:

installing drywall on studs;

prior to substantially installing drywall, installing satellite wire within walls of the building;

terminating a satellite wire to form a first termination outside the house;

terminating said satellite wire in a room;

coupling the wires to a satellite jack.

In yet another aspect of the invention, a satellite ready building comprises a plurality of studs and satellite wires positioned adjacent to the studs having a first termination and a second termination. A connector is coupled to the second termination of the wires. The first termination is coupled through the roof or the siding of the building. Drywall is installed in the house after the wires are installed. The first termination may be installed in a radome positioned on the roof of the building.

One advantage of the invention is that the satellite broadcasting company may choose to subsidize builders so that they install satellite wires throughout the house. The service company may also provide a radome for installation on the roof of the building which will house a flat satellite antenna. Another advantage of the invention is that once the radome is installed, various types of flat antennas may be placed therein. Therefore, as service requirements change, various antennas may be installed therein.

Other objects and features of the present invention will become apparent when viewed in light of the detailed description of the preferred embodiment when taken in conjunction with the attached drawings and appended claims.

BEST MODES FOR CARRYING OUT THE INVENTION

Figure 1:
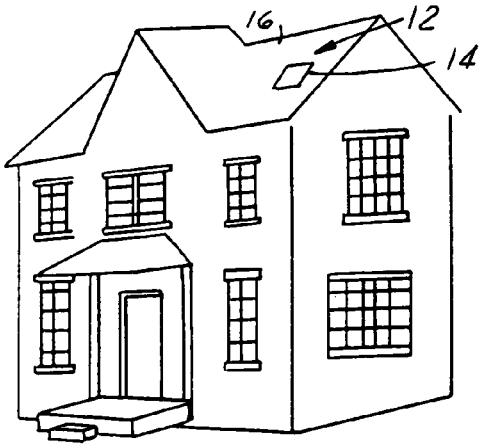
FIG. 1 is a perspective view of a satellite ready house according to the present invention.

In the following figures the same reference numerals are used to identify the same components in the various views. The present invention is described with respect to a house. However, those skilled in the art would recognize that the satellite ready concept is applicable to various types of buildings including commercial buildings and multiple-unit family dwellings.

Referring now to FIG. 1, a building such as a house 10 has a satellite ready installation 12 (only part of which is shown). For example, satellite ready home may include a radome 14 installed upon a roof 16 or vertically on the siding of the home. Vertical installation may be preferred in snowy climates. Radome 14 encloses a flat satellite antenna therein.

For aesthetic purposes, the radome 14 may be colored the same as or close to the color of the roof.

Figure 2:
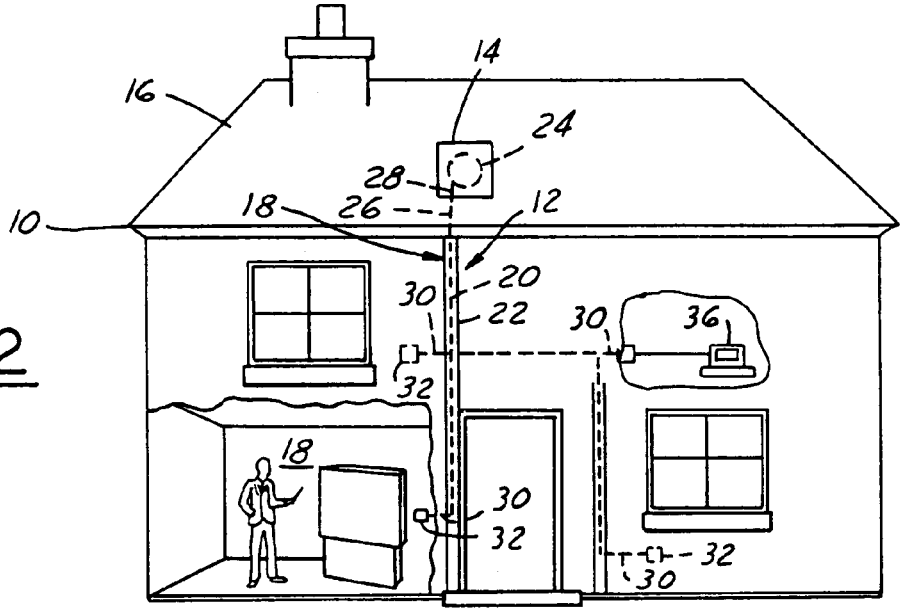
FIG. 2 is a front elevational view of a home prewired according to the present invention.

Referring now to FIG. 2, a partial cutaway view of house 10 is illustrated. House 10 has walls 18 formed of studs 20 having drywall 22 mounted to the outside thereof.

Satellite ready installations may include radome 14 housing a satellite antenna 24 therein. The satellite antenna 24 is coupled to satellite wires 26. Satellite wires 26 may, for example, be coaxial wires or other types of wires suitable for use in satellite communications systems. The type of satellite wire may vary depending on the various system parameters. The satellite wires 26 preferably extend to nearly every room in the house and more preferably extend to every room in the house. Satellite wires 26 have a first termination 28 within radome 14 and a plurality of other second terminations 30 in the various rooms of the house. First termination 28 is to be coupled to a satellite signal receiving device or antenna. Second terminations 30 are coupled to a connector 32. One suitable example of a connector is described below with respect to FIG. 7 and is referred to as a universal connector. Connector 32 may be used to couple satellite wires and therefore the antenna 24 to various devices such as a television 34 and a personal computer 36. Various types of services may be provided through satellite antenna 24. Also, those skilled in the art would recognize that more than one satellite antenna 24 and more than one radome 14 may be installed on a roof 16 if various services require various directional pointing or other types of antennas.

Figure 3A:
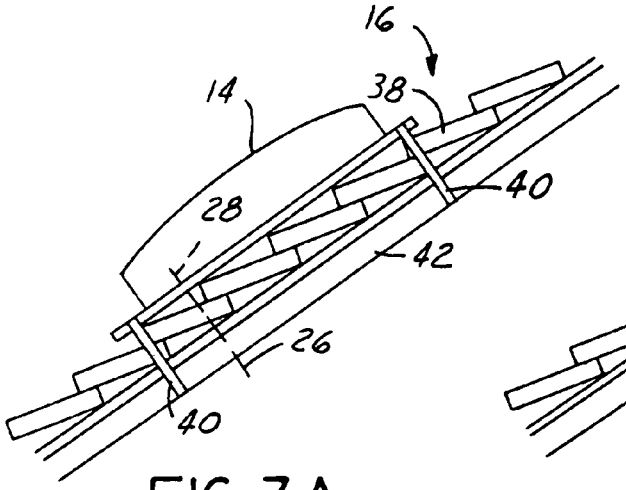
FIG. 3*a* is a cross-sectional view of a radome.

Referring now to FIG. 3*a*, a radome 14 is shown mounted upon shingles 38 of roof 16. Fasteners 40 such as screws may be used to mount radome 14 to rafters 42. Also illustrated is first termination 28 of satellite wires 26 that extend therein. First termination 28 is coupled to satellite antenna 24.

Figure 3B:
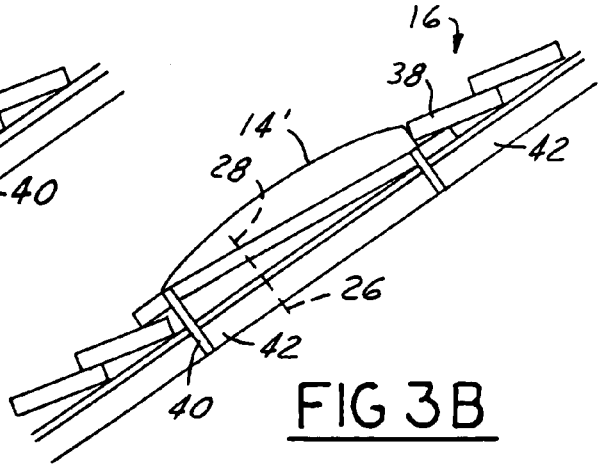
FIG. 3*b* is a low profile radome according to the present invention.

Referring now to FIG. 3*b*, a second embodiment of a radome 14 is illustrated. In this embodiment, radome 14 is installed during the installation of roof 16 so that radome 14 is partially under shingles 38. In both embodiments, radome 14 is preferably formed of a material that will not block satellite communication signals from reaching the satellite therein. For example, various types of plastics may be used. The plastics may also be colored to blend with the colors of the materials of the house. Advantageously, the radomes are low profile and therefore are more aesthetically pleasing to prior known mounting methods.

Figure 4:
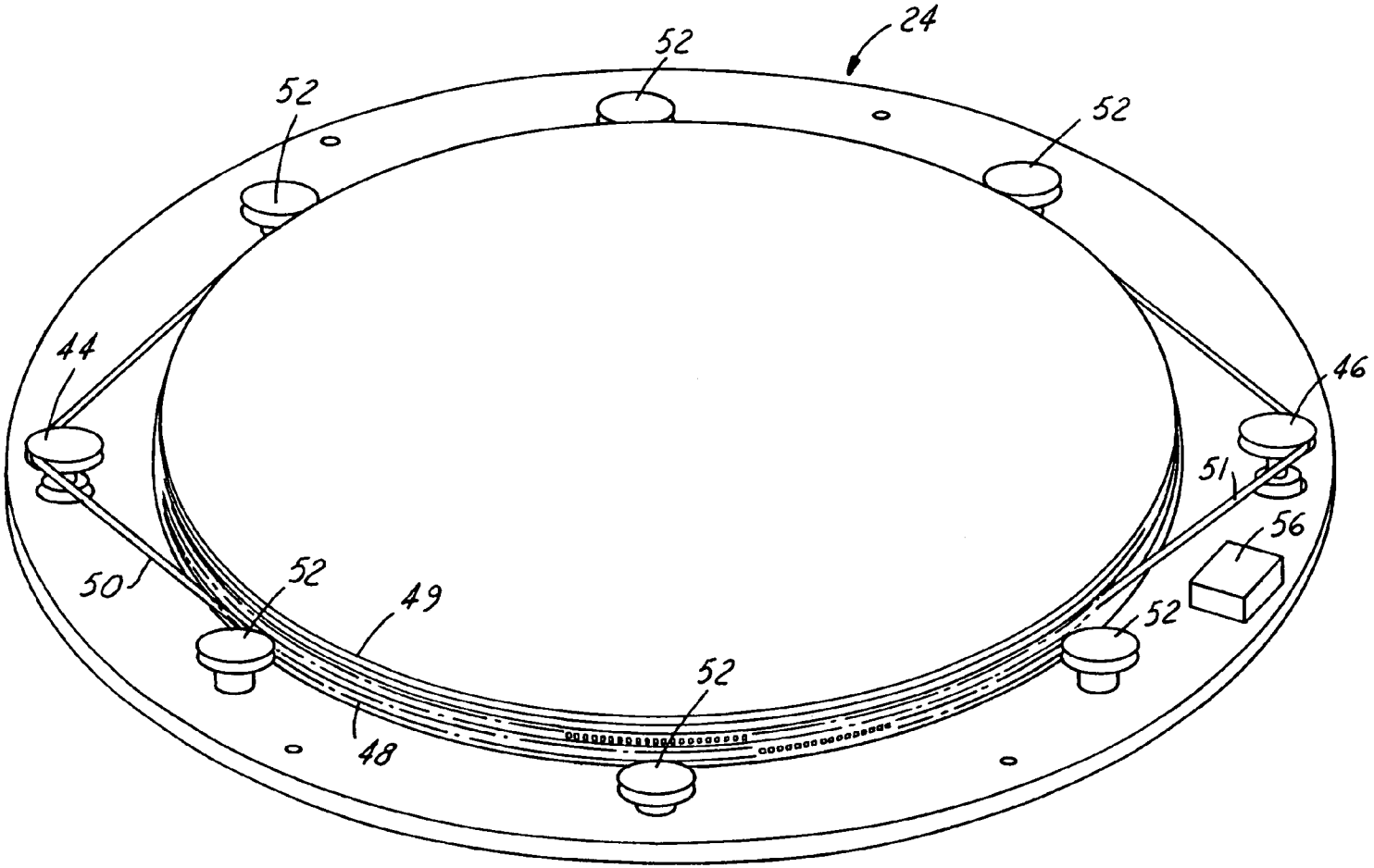
FIG. 4 is a perspective view of a low profile antenna for use in the present invention.

Referring now to FIG. 4, a first embodiment of a satellite antenna 24 is illustrated. Antenna 24 is a conceptual variable-inclination-continuous-transverse-stub (VICTS) antenna. Antenna 24 has a feed base motor 44 and an aperture motor 46. Motors 44, 46 perform azimuth and elevation steering, respectively. Both base motor 44 and aperture motor 46 are coupled to a respective disc 48, 49 through a respective belt 50, 51. A plurality of rollers 52 are positioned around a base 54 to guide the movement of discs 48, 49. One constructed embodiment of an antenna 24 has a low profile having a thickness of 1.2 inches. The constructed prototype had a high efficiency above 80 percent with a wide scan range.

The movement of the discs 48, 49 may be controlled remotely by the device user. Of course, those skilled in the art would recognize that automatic or semi-automatic steering may be used. Base 54 may also incorporate a GPS receiver 56 so that relative positional information may be provided to the user.

As will be evident to those skilled in the art, motors 44, 46 may be eliminated if a one-time installation with a single pointing direction is desired. This will simplify the design of the antenna 24 and reduce the cost of the system.

Figure 5:
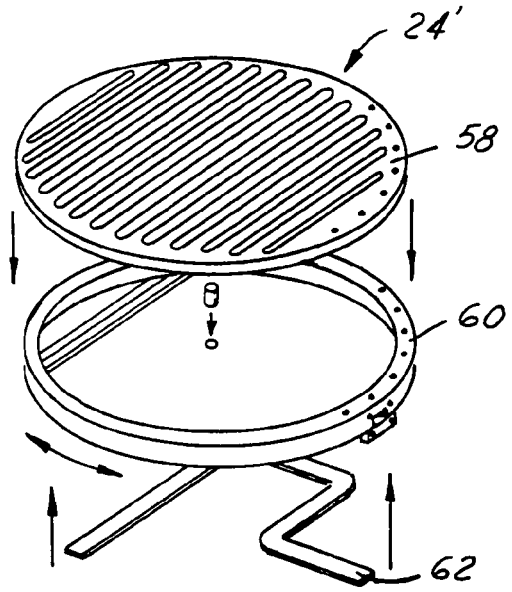
FIG. 5 is a perspective view of a second embodiment of a flat antenna according to the present invention.

Referring now to FIG. 5, a phase array antenna 24 is illustrated. Phase array antenna 24 contains a plurality of elements located in disc 58. Disc 58 is coupled to a rotating frame 60. Rotating frame 60 is coupled to a mount 62 that allows the frame 60 to rotate relative thereto. A phase array antenna 24 may be used for both transmitting and receiving information from a satellite. Phase array antenna 24 may also not provide rotating frame 60 and use an electronically steerable apparatus. Various types of phase array antennas will be known to those skilled in the art. These types of antennas are typically flat so that the low profile aesthetic appeal may be maintained.

For use with geostationary orbit satellites, a single pointing direction such as that used in DirecTV® systems may be used. In this manner, the satellite antenna 24 need only be pointed once.

Another type of antenna is a receive only antenna with semi-automatic steering terminals. The terminal may be steered to a particular location based upon the touch of a button. For example, if two geostationary satellites are used in different orbital slots, the satellite antenna may jump between a particular satellite by changing its direction.

Also as will be evident to those skilled in the art, two antennas may be provided, one for transmitting and one for receiving. In this manner, additional power may be provided to the transmitting antennas.

A low profile antenna can be also mounted as a wall device instead of a roof-top device. This feature is extremely valuable for the usage in high altitude regions where the elevation angles to GSO satellites is low, where the scanning angles from a wall device is smaller than from a roof device, and where snow covering is a problem. A wall mounted device can achieve advantages of smaller scanning angle and less snow blockage.

The satellite ready installation 12 may be also suitable for use with non-geostationary orbit satellites such as low earth orbit satellites or medium earth orbit satellites. In this manner, the antenna may be caused to continuously move and track the moving satellite. Such systems are believed to be slightly more expensive than stationary systems because a movement mechanism must be provided. However, if mass produced a tracking type system could be relatively inexpensive.

Figure 6:
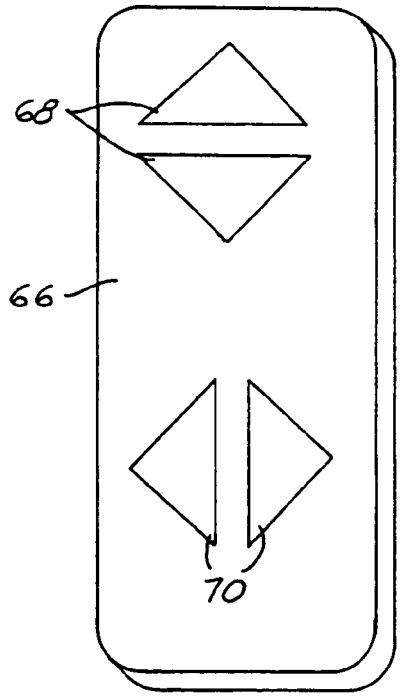
FIG. 6 is a perspective view of an adjusting device according to the present invention.

Referring now to FIG. 6, a remote control 66 may be used to control the direction of the antenna 24 if a moveable beam is used. Remote control 66 may, for example, have elevation buttons 68 and azimuth buttons 70 that may be depressed in order to change the direction of the receiving beam. The remote control 66 may also be simplified if a fixed number of fixed position satellites are used, a simple selection button may be implemented to move the direction of the receiving beam to the particular satellites. Remote control 66 may be wireless or may be wired directly to the antenna 24.

Figure 7:
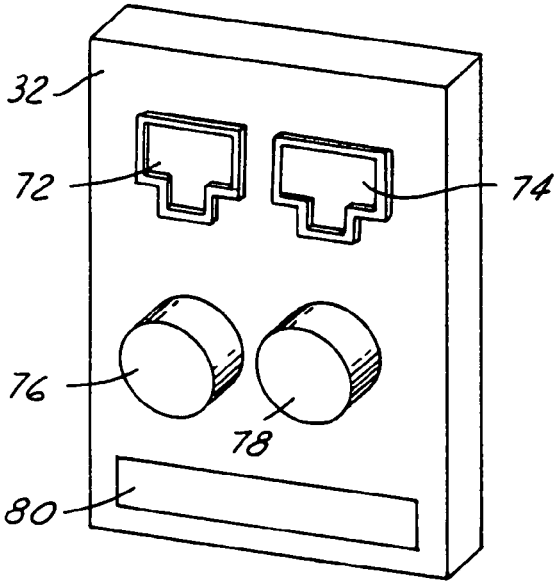
FIG. 7 is a perspective view of a universal connector according to the present invention.

Referring now to FIG. 7, one suitable connector 32 is illustrated. As described herein, the connector is referred to as a universal connector because it comprises a number of jacks including a phone jack 72, a LAN jack 74, a cable jack 76, and a satellite jack 78. Preferably, at least one jack is located in each room of the house. Also, at least a satellite connection is provided. Such a system is particularly suitable for DirecTV® or DirecPC™ because both require a twisted pair of phone jacks 72 and a coaxial cable for its uplink and downlink signals respectively. Because homes of the future are likely to have a local area network therein, an IP address 80 may be associated with each jack.

Of course, various other types of low profile antennas may be included within radome 14. For example, a spiral antenna, many forms of electronically steerable array antennas or other types of electronically/mechanically steerable hybrid antennas may be used. Also, the outdoor unit may vary in size depending on the type of function that it is used for. For example, transmitting and receiving antennas may require different size radomes. Also, the antenna may vary depending on the frequency band it is designed to receive.

In operation, the satellite broadcast provider may provide incentives such as subsidizing or partially subsidizing the satellite ready installation 12. In such a case, the satellite provider may contact a builder prior to or during the building of the house. An electrician may install the proper wiring and the connectors 32 during installation of phone and cable wiring. Various business models may be used, for example, providing the builder with the radomes, wiring, and potentially even paying for labor for the installation of the wiring in the radome. The owners of the home may also be contacted wherein an incentive such as rebates or free monthly service for a predetermined amount of time for authorizing the installation of the satellite ready installation 12. By providing some subsidization, the entry barrier for the satellite service would be reduced for the homeowner and thus homeowners would be more likely to subscribe to such a service.

The satellite wiring is installed into the building during the installation of the other electrical wires. That is, the wiring is installed before the drywall is installed in the building. This makes routing of the wires easier, more convenient, and aesthetically pleasing. The wiring may have its second termination not connected to a connector until the drywall has been installed. For example, the second termination 30 may terminate in a common used electrical box and after the drywall is installed the termination will be coupled to a connector 32.

The antenna may be installed in the radome before or after the house is completely built. It is envisioned though that the satellite antenna will be installed after the house is completed and the building is occupied. The radome 14 is preferably installed during the installation of the shingles or other roof covering. This will provide the most weatherproof installation for radome 14. This will also provide the most built-in aesthetically pleasing look.

While particular embodiments of the invention have been shown and described, numerous variations alternate embodiments will occur to those skilled in the art. Accordingly, it is intended that the invention be limited only in terms of the appended claims.

What is claimed is:

1. A satellite ready building comprising:

a plurality of studs;

satellite wires positioned adjacent to said studs having a first termination and a second termination, said first termination positioned outside the building;

a connector coupled to said second termination of said satellite wire;

a drywall layer coupled to said studs to substantially enclose the satellite wires therein; and a low-profile radome for housing a satellite antenna, enclosing said first termination and disposed contiguous with a surface of the satellite ready building.

2. A satellite ready building as recited in claim 1 wherein said connector comprises a universal connector.

3. A satellite ready building as recited in claim 2 wherein said universal connector comprises a phone jack, a cable TV jack, and a satellite jack.

4. A satellite ready building as recited in claim 3 wherein said universal connector comprises a LAN jack.

5. A satellite ready building as recited in claim 1 further comprising a satellite antenna positioned within said radome.

6. A satellite ready building as recited in claim 5 wherein said radome has a color to substantially match a roof color.

7. A satellite ready building as recited in claim 5 wherein said antenna comprises a flat antenna.

8. A satellite ready building as recited in claim 5 further comprising a remote control for positioning said antenna.

9. A satellite ready building as recited in claim 5 wherein said antenna comprises a phase array antenna.

10. A satellite ready building as recited in claim 5 wherein said antenna comprises a variable-inclination-continuous-transverse-stub.

11. A satellite ready building comprising:

a plurality of studs;

satellite wires positioned adjacent to said studs having a first termination and a second termination, said first termination positioned outside the building;

a connector coupled to said second termination of said satellite wire;

a drywall layer coupled to said studs to substantially enclose the satellite wires therein;

a low-profile radome enclosing said first termination and disposed contiguous with a surface of the satellite ready building, said surface having a first color, said radome having a second color blending with the first color to provide an aesthetically pleasing look; and a satellite television broadcast antenna disposed within the radome.

12. A satellite ready building as recited in claim 11 wherein the surface comprises a roof.

13. A satellite ready building as recited in claim 11 wherein the surface comprises siding.

14. A satellite ready building as recited in claim 11 wherein the antenna comprises a low profile antenna.

15. A satellite ready building as recited in claim 11 wherein said antenna comprises a flat antenna.

16. A satellite ready building as recited in claim 11 wherein said antenna comprises a phase array antenna.

17. A satellite ready building as recited in claim 11 wherein said antenna comprises a variable-inclination-continuous-transverse-stub.

* * * * *